US009518470B2

(12) United States Patent
Illand et al.

(10) Patent No.: US 9,518,470 B2
(45) Date of Patent: Dec. 13, 2016

(54) DEVICE FOR ATTACHING BLADES TO A TURBINE ENGINE ROTOR DISK

(71) Applicants: SNECMA, Paris (FR); HERAKLES, Le Haillan (FR)

(72) Inventors: Hubert Illand, Bonchamp les Laval (FR); Didier Fabre, Avon (FR); Amaury Roussely-Rousseau, Paris (FR)

(73) Assignees: SNECMA, Paris (FR); HERAKLES, Le Haillan (FR)

( * ) Notice: Subject to any disclaimer, the term of this patent is extended or adjusted under 35 U.S.C. 154(b) by 662 days.

(21) Appl. No.: 13/892,601

(22) Filed: May 13, 2013

(65) Prior Publication Data

US 2013/0302171 A1 Nov. 14, 2013

(30) Foreign Application Priority Data

May 14, 2012 (FR) ..... 12 54371

(51) Int. Cl.
*F01D 5/30* (2006.01)
*F01D 5/28* (2006.01)

(52) U.S. Cl.
CPC ..... *F01D 5/282* (2013.01); *F01D 5/3007* (2013.01); *F01D 5/3053* (2013.01); *F05D 2230/90* (2013.01); *F05D 2300/6033* (2013.01)

(58) Field of Classification Search
CPC ..... F01D 5/282; F01D 5/3053; F01D 5/3007; F05D 2300/6033; F05D 2230/90
See application file for complete search history.

(56) References Cited

U.S. PATENT DOCUMENTS 2,790,620 A * 4/1957 Rankin ..... F01D 5/3053 416/217
2,957,675 A * 10/1960 Mason ..... F01D 5/10 416/193 A
2,974,924 A * 3/1961 Rankin ..... F01D 5/225 415/173.7

(Continued)

FOREIGN PATENT DOCUMENTS

DE 1 023 052 1/1958
EP 2 363 574 A2 9/2011

(Continued)

OTHER PUBLICATIONS

U.S. Appl. No. 13/909,282, filed Jun. 4, 2013, Roussely-Rousseau, et al.

(Continued)

*Primary Examiner* — Igor Kershteyn
*Assistant Examiner* — Eldon Brockman
(74) *Attorney, Agent, or Firm* — Oblon, McClelland, Maier & Neustadt, L.L.P.

(57) ABSTRACT

A device for attaching blades to a rotor disk of a turbine engine is provided. The device includes: a rotor disk provided at its outer periphery with a plurality of slots, each slot being formed between two adjacent disk teeth and extending axially between front and rear faces of the disk; a plurality of blades, each having a respective root mounted in a slot of the disk; and at least one pin mounted in the rotor disk to pass through the roots of at least two adjacent blades and extending between the front and rear faces of the rotor disk so as to attach the blades to the rotor disk.

13 Claims, 2 Drawing Sheets

(56) References Cited

U.S. PATENT DOCUMENTS

| | | | | | |
|---|---|---|---|---|---|
| 2,999,668 | A * | 9/1961 | Howald | F01D 5/081 | 416/217 |
| 3,746,468 | A | 7/1973 | Saunders | | |
| 4,084,922 | A * | 4/1978 | Glenn | F01D 5/3084 | 416/193 A |
| 4,802,824 | A | 2/1989 | Gastebois et al. | | |
| 5,062,769 | A * | 11/1991 | Ortolano | F01D 5/3053 | 416/217 |
| 5,409,353 | A * | 4/1995 | Imbault | F01D 5/3053 | 416/212 A |
| 6,364,613 | B1 * | 4/2002 | Deallenbach | F01D 5/3053 | 415/115 |
| 9,175,571 | B2 * | 11/2015 | Floyd | F01D 5/284 | |
| 2011/0206522 | A1 * | 8/2011 | Alvanos | F01D 5/282 | 416/204 R |
| 2013/0243601 | A1 * | 9/2013 | Floyd | F01D 5/284 | 416/220 R |

FOREIGN PATENT DOCUMENTS

| | | |
|---|---|---|
| EP | 2 386 721 A1 | 11/2011 |
| FR | 1 070 291 | 7/1954 |
| FR | 2 608 674 | 6/1988 |
| GB | 731 456 | 6/1955 |

OTHER PUBLICATIONS

French Preliminary Search Report issued Feb. 1, 2013, in French 12 54371, filed May 14, 2012 ( with English Translation of Category of Cited Documents).

* cited by examiner

DEVICE FOR ATTACHING BLADES TO A TURBINE ENGINE ROTOR DISK

BACKGROUND OF THE INVENTION

The present invention relates to the general field of attaching blades to a turbine engine rotor disk.

A preferred but non-exclusive field of application of the invention is in particular that of blades made of composite material for the low pressure turbine of a turbojet of the two-spool bypass type.

The low pressure turbine of a turbojet is made up of a plurality of stages, each stage having a nozzle (i.e. a grid of stationary vanes) and a rotor wheel arranged behind the nozzle. Each rotor wheel comprises a rotor disk having a plurality of blades mounted thereon via their roots, with attachment systems serving to hold the blades on the disk.

The blades of turbine rotor wheels are subjected to high levels of external force, such as contact force at a blade tip, aerodynamic force from the gas, and more particularly centrifugal force that is generated by the rotation of the rotor disk. These forces are countered by the retaining force exerted by the rotor disk, with this force passing via systems for attaching blades to the disk.

The forces that need to pass through the system for attaching blades to the rotor disk are very large. The attachment systems must therefore withstand these forces in an environment that presents fluctuating temperatures (temperature varies between ambient temperature and about 700° C.) and in a limited amount of space.

It has also become common practice to make turbine blades out of composite material, and in particular ceramic matrix composite (CMC) material. By way of example, reference may be made to patent application WO 2010/061140, which describes a method of fabricating such blades.

Compared with metal turbine blades, composite material turbine blades nevertheless present drawbacks associated with their system for attaching them to the rotor disk. Known systems for attaching composite material blades to a rotor disk have difficulties in mechanically withstanding the forces that they need to transfer and they deteriorate rapidly in terms of fatigue and oxidation.

This applies in particular to the attachment systems provided by having co-operating shapes between bulb-shaped blade roots and the slots in the rotor disk in which the roots are mounted. With that type of attachment, the retaining forces exerted by the rotor disk on the root of a blade give rise to a compression effect on the layers of fiber texture (i.e. the force is perpendicular to the direction of the layers in the fiber texture) because of the way the fiber texture layers in the composite material are oriented in order to extend in directions that are parallel to the bearing surfaces of the rotor disk against which they press. This causes the blade roots to deteriorate. Furthermore, fabricating a composite material blade with a bulb-shaped root is relatively complex and expensive.

OBJECT AND SUMMARY OF THE INVENTION

A main object of the present invention is to thus to mitigate such drawbacks by proposing a device for attaching blades to a rotor disk that does not cause the blade roots to deteriorate.

In accordance with the invention, this object is achieved by a device for attaching blades to a rotor disk of a turbine engine, comprising: a rotor disk provided at its outer periphery with a plurality of slots, each formed between two adjacent disk teeth and extending axially between front and rear faces of the disk; a plurality of blades, each having a respective root mounted in a slot of the disk; and at least one pin mounted in the rotor disk to pass through the roots of at least two adjacent blades and extending between the front and rear faces of the rotor disk so as to attach the blades to the rotor disk.

The pin of the attachment device of the invention thus passes through blade roots in a direction that is substantially perpendicular to the roots. As a result, when the blades are made of composite material, the retaining forces exerted by the rotor disk on the blade roots act essentially within the planes of the layers of fiber texture making up the blades (i.e. in the directions of the warp yarns and of the weft yarns making up the various layers of the fiber texture of the composite material blades). These force directions present mechanical strength that is considerably greater than the direction perpendicular to the layers of fiber texture. This results in the blade roots having good mechanical strength for withstanding the retaining forces exerted by the rotor disk.

Furthermore, using the same pin to pin two (or more) blades makes it possible to allow the blades (when made of composite material) to move in translation relative to the rotor disk (when it is made of metal) in such a manner as to compensate for thermal expansion differences between those parts.

The cost of producing blades associated with the attachment device of the invention can be smaller than the cost of producing blades provided with bulb-shaped roots. The attachment device of the invention makes it possible for the fiber structure to retain a slab shape when forming the blade roots. The overall size thereof is also smaller, in particular compared with an attachment system using blade roots in the form of bulbs, and the pins are easy to install.

The attachment device of the invention may have at least two pins passing right through the roots of at least two adjacent blades, said pins being regularly spaced apart from one another and extending in directions that are substantially parallel.

Each pin of the attachment device may pass through the roots of three adjacent blades.

Each pin of the attachment device may emerge in the front and rear faces of the rotor disk in the teeth of the disk, thereby making installation and removal easier.

In order to reduce hammering pressures between the blades and the pin, the pin may present a right section that is circular, elliptical, or rectangular in shape. In addition, each pin may be of straight or curved shape.

The root of each blade may present at least one hole for passing a pin, the hole having surface treatment or an insert in order to improve its structural strength. In addition, when the blades are made of composite material, a zone of the root of each blade in the vicinity of the holes may be reinforced in order to improve the structural strength of the blades.

Each blade may be made of ceramic matrix composite (CMC) material, with the rotor disk and each pin being made of metal material.

The invention also provides a low pressure turbine for a turbojet, the turbine having at least one attachment device as defined above, and it also provides a turbojet including such a low pressure turbine.

BRIEF DESCRIPTION OF THE DRAWINGS

Other characteristics and advantages of the present invention appear from the description given below with reference to the accompanying drawings that show an embodiment having no limiting character. In the figures.

DETAILED DESCRIPTION OF THE INVENTION

Figure 1:
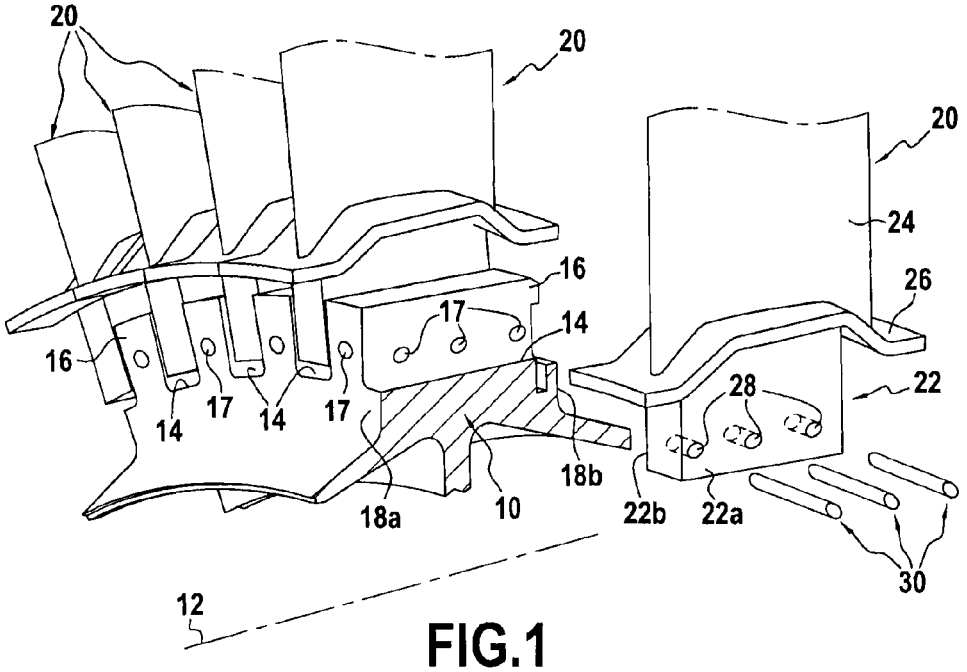
FIGS. 1 and 2 are fragmentary perspective views of a rotor disk having blades mounted thereon by means of an attachment device of the invention.
Figure 2:
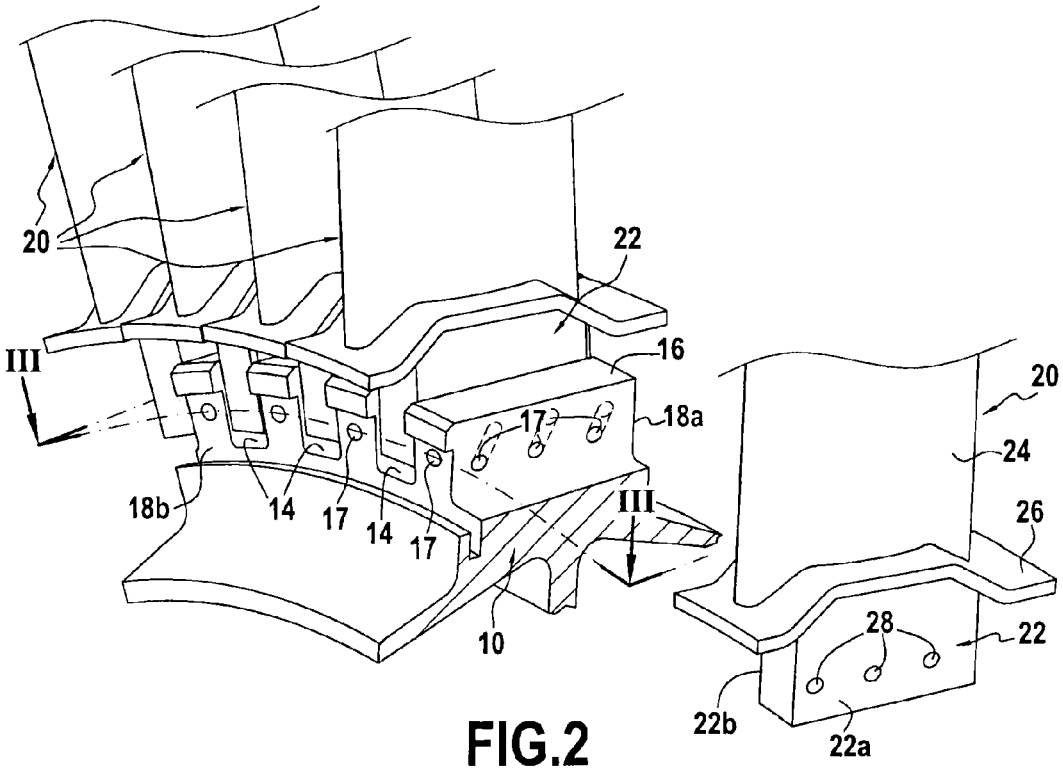

The invention is applicable to any turbine engine spool having a rotor disk with blades mounted thereon, e.g. a low pressure turbine of a turbojet of the two-spool bypass type.

In known manner, a low pressure turbine comprises a plurality of stages, each made up of a nozzle and a rotor wheel arranged behind the nozzle. Each nozzle has a plurality of stationary vanes that are arranged in the annular flow passage for the stream of gas passing through the turbine. Likewise, each rotor wheel of the turbine comprises a rotor disk having rotor blades mounted thereon via their roots and arranged in the flow passage.

FIGS. 1 to 4 are fragmentary views of a rotor disk 10 of a low pressure turbine rotor wheel fitted with an attachment device in accordance with the invention.

The rotor disk 10 is centered on a longitudinal axis 12 of the low pressure turbine. At its outer periphery, it is provided with a plurality of slots 14, each formed between two adjacent disk teeth 16. These slots 14 extend axially between the front and rear faces 18*a* and 18*b* of the rotor disk, into which faces they open out.

The rotor disk 10 is typically made of a metal material, e.g. out of Inconel®.

Blades 20 of composite material are mounted in respective slots 14 of the rotor disk. For this purpose, each blade has a root 22 that is in the form of a slab that is substantially in the shape of a rectangular parallelepiped, having two opposite side flanks 22*a*, 22*b* and that is engaged in a slot 14 of the rotor disk, being held thereto by means of an attachment device that is described below.

In known manner, each blade 20 also has an airfoil 24 that is connected to its root 22 via an inner platform 26 that defines the inside of the flow passage for the gas stream through the turbine.

Furthermore, the blades 20 are made of composite material, preferably of ceramic matrix composite (CMC) material, made up of fiber reinforcement obtained by three-dimensionally weaving yarns, and densified by a matrix.

Reference may be made to document WO 2010/061140, which describes an example of a method of fabricating a composite material turbine blade, which method consists in making a fiber blank as a single piece by three-dimensional weaving, shaping the fiber blank so as to obtain a single-piece fiber preform with a first portion forming a preform for the airfoil and the blade root, and with at least one second portion forming a preform for an inner or an outer platform of the blade, with the preform then being densified with a matrix in order to obtain a composite material blade made up of fiber reinforcement constituted by the preform and densified by the matrix, and forming a single piece that includes one or two platforms incorporated therein.

The blades 20 are mounted on the rotor disk 10 and they are held thereto by means of an attachment device in accordance with the invention.

According to the invention, such an attachment device comprises in particular at least one pin 30 that is mounted on the rotor disk 10 to pass through the root 22 of at least two adjacent blades 20 and leading to the front and rear faces 18*a* and 18*b* of the rotor disk.

Thus, the present invention seeks to hold the blades on the rotor disk by pinning their respective roots.

The pinning technique allows the CMC blades and the metal rotor disk to move relative to one another in translation (in the tangential direction) so as to compensate for differences in thermal expansion between those parts.

Figure 3:
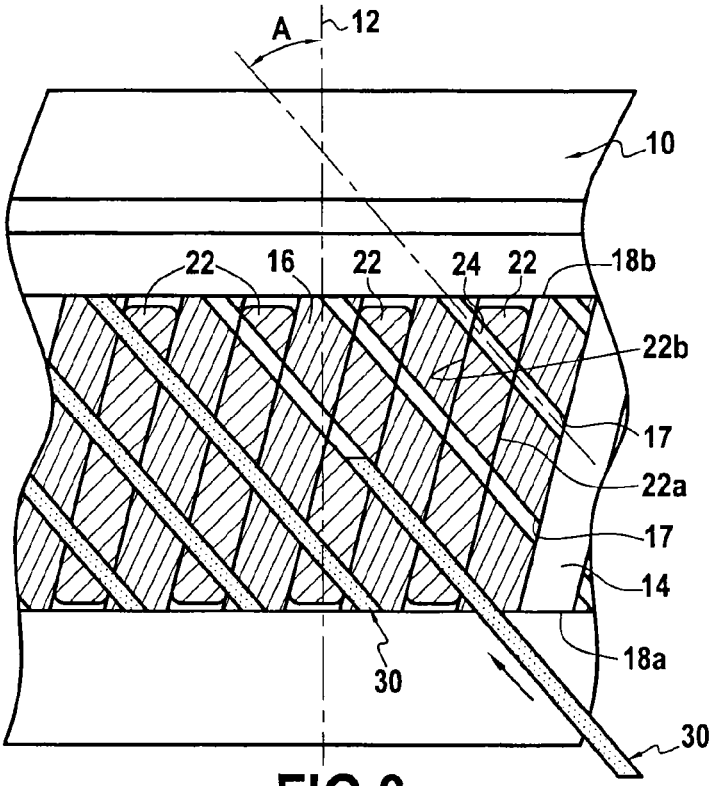
FIG. 3 is a section view on of FIG. 2.
Figure 4:
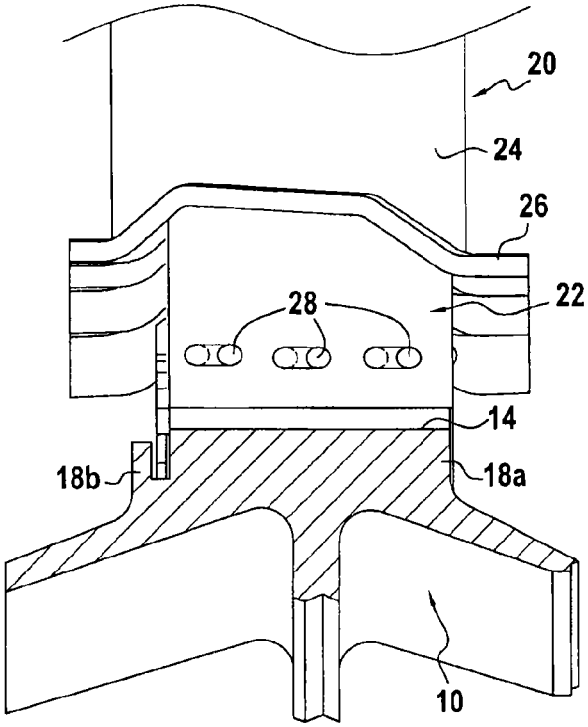
FIG. 4 is a side view of the rotor disk of FIGS. 1 and 3.

As shown in FIG. 3, the pins 30 are straight rods that pass right through the roots 22 of the blades. More precisely, each pin passes through the root of a blade in a direction that is substantially perpendicular to its side flanks 22*a*, 22*b* and extends axially between the front and rear faces 18*a*, 18*b* of the rotor disk in the teeth 16 thereof.

The pins 30 mounted in this way on the rotor disk 20 thus lie at an angle A, e.g. in the range 20° to 60°, relative to the longitudinal axis 12 of the low pressure turbine (see FIG. 3).

Furthermore, the pins 30 are rods made of a metal material, e.g. of Inconel®, ensuring they have a certain amount of flexibility to make them easier to mount in the rotor disk.

It should be observed that the pins need not be necessarily be straight and that they could be oblique, i.e. they could be of a curved shape.

In order to enable the pins to be mounted in the roots 22 of the blades 20, each root has a hole 28 passing right through it. The same applies to the teeth 16 of the rotor disk 10 that are likewise pierced by holes 17.

The holes 28 in the blade roots could be made by using a tool of the drill type. Nevertheless, in order to improve the structural strength of the blades, and in particular of their roots, it is possible to form the holes during the operation of three-dimensionally weaving the fiber blank that is to form a blade root preform by locally spacing apart the warp yarns and the weft yarns.

The pins 30 may be held in place in various ways. For example, the pins may possess elasticity in a diametrical direction (so-called "Mecanindus®" pins) and they may be mounted as tight fits in the holes 17 in the teeth of the rotor disk. Alternatively, it is possible for them to be held axially relative to the rotor disk by adding an annular plate against the face 18*a* of the rotor disk or by adding small plates forming safety catches against the face 18*b* of the rotor disk.

Likewise, still for the purpose of improving the structural strength of the blades, the root zones of the blades in the vicinity of the holes may be reinforced by increasing the number of weft yarns in the fiber blade that is to form a blade root preform under the holes.

Another possibility for increasing the structural strength of the blades consists in adding surface treatment or an insert to the holes 28 (not shown in the figures).

In the embodiment shown in FIGS. 1 to 4, provision is made for four pins 30 to pass right through the roots of at least two adjacent blades, these pins being regularly spaced apart from one another and extending in directions that are substantially parallel.

Furthermore, still in the embodiment of FIGS. 1 to 4, each of these four pins 30 passes right through the roots of three adjacent blades 20.

Naturally, it is possible to envisage other blade pinning configurations.

In order to reduce hammering pressures between the blade roots and the pins, it is possible to increase the number of pins (e.g. four or five) or to increase their diameter. Likewise, the right section of the pins may be adjusted, and may thus be circular, elliptical, or rectangular.

Furthermore, in order to improve tolerance to thermal expansion differences between the CMC blades and the metal rotor disk, it is possible to make the holes 28 formed in the blade roots 22 oblong. Similarly, the pins 30 may be made flexible or they may be mounted slidably in the rotor disk.

What is claimed is:

1. A device for attaching blades to a rotor disk of a turbine engine, comprising:

a rotor disk provided at an outer periphery thereof with a plurality of slots, each slot being formed between two adjacent disk teeth and extending axially between front and rear faces of the rotor disk;

a plurality of blades, each of the blades having a respective root mounted in a respective slot of the rotor disk; and at least one pin mounted in the rotor disk to pass through the roots of at least two adjacent blades and extending between and up to the front and rear faces of the rotor disk so as to attach the blades to the rotor disk, wherein the blades are made of composite material and the rotor disk is metallic.

2. A device according to claim 1, having at least two pins passing through the roots of at least two adjacent blades, said pins being regularly spaced apart from one another and extending in directions that are substantially parallel.

3. A device according to claim 1, wherein each pin passes through the roots of three adjacent blades.

4. A device according to claim 1, wherein each pin emerges in the front and rear faces of the rotor disk in the teeth of the disk.

5. A device according to claim 1, wherein each pin is made of a metal material.

6. A device according to claim 1, wherein each pin presents a cross section of circular, elliptical, or rectangular shape.

7. A device according to claim 1, wherein each pin is of straight or curved shape.

8. A device according to claim 1, wherein the root of each blade presents at least one hole for passing a pin, the hole having surface treatment or an insert.

9. A device according to claim 8, wherein a zone of the root of each blade in the vicinity of the holes are reinforced.

10. A device according to claim 1, wherein each blade is made of ceramic matrix composite material.

11. A low pressure turbine for a turbojet, the turbine having at least one device according to claim 1.

12. A turbojet including a low pressure turbine according to claim 11.

13. A device according to claim 1, wherein each pin passes through a channel constituted by holes formed in the teeth of the rotor disk and holes formed in the roots of the blades, the channel having a first end at the front face of the rotor disk and a second end at the rear face of the rotor disk.

* * * * *